US006507719B2

(12) United States Patent
Furuya

(10) Patent No.: US 6,507,719 B2
(45) Date of Patent: Jan. 14, 2003

(54) IMAGE FORMING APPARATUS WITH PRE-EXPOSED IMAGE BEARING BODY

(75) Inventor: Tadashi Furuya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/891,585

(22) Filed: Jun. 27, 2001

(65) Prior Publication Data

US 2002/0012548 A1 Jan. 31, 2002

(30) Foreign Application Priority Data

Jun. 30, 2000 (JP) ..... 2000-199431

(51) Int. Cl.[7] ..... G03G 21/06; G03G 21/08; G03G 15/02

(52) U.S. Cl. ..... 399/128; 399/175

(58) Field of Search ..... 399/128, 129, 399/174, 175

(56) References Cited

U.S. PATENT DOCUMENTS 5,822,659 A * 10/1998 Ishiyama ..... 361/225

FOREIGN PATENT DOCUMENTS

JP 9-325668 * 12/1997

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes an image bearing body. The image bearing body is charged by a charging device including a magnetic brush which is brought into contact with the image bearing body and which is formed by a magnetic particle layer. The image bearing body is exposed by a pre-exposing device after an image formed on the image bearing body is transferred to an image receiving member and before the photosensitive body is charged by the charging device. The pre-exposing device exposes the image bearing body with an exposure width smaller than a width with which the charging device charges the image bearing body in a longitudinal direction of the charging device. The exposure width is larger than an image formation width in the longitudinal direction of the charging device.

14 Claims, 5 Drawing Sheets

IMAGE FORMING APPARATUS WITH PRE-EXPOSED IMAGE BEARING BODY

BACKGROUND OF THE INVENTION

1. Field of the Invention

The present invention relates to a transfer image forming apparatus using an electrophotographic process or electrostatic recording process and, more particularly, to an apparatus for forming an image by using a magnetic brush contact charging apparatus as a charging processing means.

2. Related Background Art

As a photosensitive body used in a transfer electrophotographic image forming apparatus, an organic photosensitive body, amorphous-silicon-based photosensitive body (to be referred to as an a-Si-based photosensitive body hereinafter), or the like is often used. The a-Si-based photosensitive body has high surface hardness, exhibits high sensitivity with respect to a semiconductor laser or the like, and suffers almost no deterioration due to repetitive use, and hence is used as an electrophotographic photosensitive body for a high-speed copying machine or laser beam printer (LBP).

As a charging processing means for a photosensitive body, a corona charging apparatus using electric discharge has been put into practice. However, since the a-Si-based photosensitive body has a relative dielectric constant as large as 11 to 12, which is larger than that of an organic photosensitive body, the capacitance is large. As a consequence, for example, the charging ability tends to deteriorate, and image deletion tends to occur due to latent image deletion caused by discharge.

In contrast to this, if the a-Si-based photosensitive body is charged by a contact charging member using a conductive roller, a fur brush, a magnet roller bearing magnetic particles, or the like, since the surface of the a-Si-based photosensitive body is formed by a layer of $10^9$ to $10^{14}$ Ωcm, a charge potential almost equivalent to the DC component of a bias applied to the contact charging member can be obtained on the photosensitive body surface.

Such a charging method is called "injection charging" because the photosensitive body is charged by directly injecting charge into the body without using discharge. If this injection charging is used, completely ozoneless, low-power-consumption charging can be performed because the photosensitive body is charged without using any discharge phenomenon as in a case where a corona charging apparatus is used. This technique therefore has attracted a great deal of attention. In addition, this can prevent a deterioration in charging ability and image deletion. Furthermore, since the photosensitive body is charged at a potential near the applied voltage, potential control is facilitated.

In a contact charging apparatus of a magnetic brush scheme as a kind of injection charging scheme, conductive magnetic particles (carriers) are magnetically constrained as a magnetic brush on a magnet directly or on a sleeve incorporating a magnet, and the magnetic brush is brought into contact with the photosensitive body while being stopped or rotated. By applying a voltage to the magnetic brush, charging is started.

FIG. 2 is a cross-sectional view showing an example of the schematic arrangement of a magnetic brush contact charging apparatus 30. The magnetic brush contact charging apparatus of this example is of a sleeve rotation type.

A rotation drum type electrophotographic photosensitive body 1 as a body to be charged is rotated/driven in the clockwise direction indicated by the arrow at a predetermined peripheral velocity (process speed), e.g., 150 mm/sec.

The charging apparatus 30 includes a housing 305 and a nonmagnetic sleeve (charging sleeve) 303 serving as a magnetic brush bearing member which is rotatably mounted in the housing 305 with its lower surface being exposed to the outside.

A magnet roller (permanent magnet roller) 302 serves as a magnetic field generating member, which is inserted in the nonmagnetic sleeve. This magnet roller 302 is a non-rotating fixed member supported on a fixed central shaft 306. The two ends of the nonmagnetic sleeve 303 are rotatably and axially supported on the two end sides of the fixed central shaft 306. The nonmagnetic sleeve 303 is coaxially rotated around the fixed magnet roller 302 at a predetermined peripheral velocity, e.g., 150 mm/sec, in the clockwise direction indicated by the arrow by a driving system (not shown), i.e., in the counter direction with respect to the photosensitive body 1.

Charging magnetic particles (carriers) are stored in the housing 305. A regulating blade 301 serves as a magnetic particle regulating means placed at the opening portion of the housing 305 at a predetermined distance from the nonmagnetic sleeve 303. The charging magnetic particles 304 in the housing 305 are magnetically constrained and borne as a magnetic brush on the outer surface of the nonmagnetic sleeve 303 by the magnetic field generated by the magnet roller 302 in the sleeve. When the charging magnetic particles 304 are rotated/conveyed upon rotation of the nonmagnetic sleeve 303 and pass through the gap between the nonmagnetic sleeve 303 and the regulating blade 301, the layer thickness is regulated to a predetermined value, and the particles are carried out as a magnetic brush 305*a* of the housing 305.

The nonmagnetic sleeve 303 is placed to oppose the photosensitive body 1 through a gap smaller than the layer thickness of the magnetic brush 304*a* having undergone the above layer thickness regulation. Therefore, the magnetic brush 304*a* whose layer thickness is regulated by the regulating blade 301 and conveyed to the gap portion where the nonmagnetic sleeve 303 opposes the photosensitive body 1 upon rotation of the nonmagnetic sleeve 303 comes into contact with the surface of the photosensitive body 1 with a width, and moves in a direction opposite to the moving direction of the surface of the photosensitive body 1 to slide on the surface of the photosensitive body 1. The nip portion width of a magnetic brush contact nip portion n (charged nip portion) is preferably adjusted to 1 to 10 mm.

The magnetic brush 305*a* passing through the gap portion where the nonmagnetic sleeve 303 opposes the photosensitive body 1 is conveyed back into the housing 305 upon rotation of the nonmagnetic sleeve 303 to be cyclically used.

When the nonmagnetic sleeve 303 is rotated, and a predetermined charging voltage is applied from a charging bias application power supply S to the nonmagnetic sleeve 303, charge is applied from the charging magnetic particles constituting the magnetic brush 305*a* onto the photosensitive body 1 in the charging nip portion n, and the rotating photosensitive drum surface is contact-charged to a value near a potential corresponding to the applied charging voltage.

In the image forming apparatus using the above a-Si-based photosensitive body, an optical memory formed in image exposing operation causes a potential difference after the photosensitive body is charged. This appears as an image. As a means for solving this problem, an ante-charge exposing apparatus (pre-exposing step) for uniformly exposing the photosensitive body is generally placed between a cleaner and a charging member. With this arrangement, an optical memory of a preceding image on the photosensitive body is erased.

An optical memory in the image forming apparatus using the above a-Si-based photosensitive body will be described in more detail below.

When the a-Si-based photosensitive body is charged, and image exposure is performed, optical carriers are generated to lower the charging potential, thereby forming an electrostatic latent image. At this time, many dangling bonds (uncombined bonds) existing in the a-Si-based photosensitive body are set at a localized level to trap some optical carriers, retarding their migration or decreasing the recombination rate of optical carriers. In the image forming process, therefore, some optical carriers generated by exposure are released from the localized level at the same time an electric field is applied to the a-Si-based photosensitive body in charging operation in the next step. As a consequence, a surface potential difference is caused on the a-Si-based photosensitive body between an exposed portion and a non-exposed portion to produce an optical memory. This finally appears as a density difference in developing operation.

In general, therefore, uniform exposure is performed in the exposing step to excessively increase latent optical carriers in the a-Si-based photosensitive body so as to make the optical carriers uniform on the entire surface, thereby erasing an optical memory. At this time, an optical memory (ghost) can be erased more effectively by increasing the amount of exposure light emitted from an ante-charge exposing apparatus or bringing the wavelength of pre-exposure light near to the spectral sensitivity peak (about 680 to 700 nm) of the a-Si-based photosensitive body.

When this ante-charge exposing apparatus is used in a system using the above magnetic brush contact charging apparatus, so-called carrier adhesion occurs. That is, charging magnetic particles used in the charging apparatus adhere to the photosensitive body.

The charging magnetic particles adhering to this photosensitive body enter a developing apparatus (developing device) located downstream in the rotating direction of the photosensitive body to interfere with toner image developing. Furthermore, in a transferring portion located downstream, such magnetic particles are transferred onto a transferring material together in image transferring operation, resulting in image defects.

This phenomenon becomes conspicuous especially when an a-Si-based photosensitive body requiring an ante-charge exposing apparatus is combined with a magnetic brush charging apparatus.

When a magnetic brush contact charging apparatus is used, carrier adhesion to a photosensitive body occurs almost in proportion to the potential difference between the voltage applied to a charging member and the charge potential of the photosensitive body. For example, in a charging scheme like an AC charging scheme in which such a potential difference always occurs, carrier adhesion occurs from the entire surface of the charging nip portion of a magnetic brush in the longitudinal direction. In this case, the longitudinal direction is a direction perpendicular to the moving direction of the photosensitive body. In the following description, the longitudinal direction indicates this direction unless otherwise specified. If, therefore, no ante-charge exposing apparatus is used, carrier adhesion can be prevented by using a charging scheme like the injection charging scheme described above in which the voltage applied to the charging member is almost equal to the potential of the photosensitive body.

In the injection charging scheme using a magnetic brush contact charging apparatus, charge is injected into a portion that is in direct contact with a photosensitive body to charge the photosensitive body to a potential almost equal to the voltage applied to the charging member. Therefore, as the number of times the portion comes into contact with the photosensitive body increases, the photosensitive body surface is charged, and its potential approaches the voltage applied to the charging member. For this reason, the density of charging magnetic particles of the magnetic brush is increased and the magnetic brush and photosensitive body are rotated in the counter directions (to move their contact surfaces in opposite directions).

As shown in FIG. 3, however, at the two end portions of the magnetic brush 304*a* on which the magnet 302 does not exist, the magnetic flux density decreases. In addition, since a pressure escapes to the portions located on the outer sides where no charging magnetic particles exist (arrow A), the toner chain of the magnetic brush 304*a* tend to become coarse. Therefore, the number of times the magnetic brush 304*a* comes into contact with the photosensitive body 1 decreases, the charging ability of the magnetic brush contact charging apparatus 30 deteriorates.

In addition, when an ante-charge exposing apparatus is used, exposure light enters the charging nip n in which the toner chain of the magnetic brush 304*a* is coarse, resulting in a decrease in the surface potential of the charged photosensitive body. As a consequence, the potential difference between each end portion of the magnetic brush and the photosensitive body surface increases, and carrier adhesion tends to occur.

For the above reasons, when an ante-charge exposing apparatus for exposing a photosensitive body to erase an optical memory in the above manner is combined with a magnetic brush contact charging apparatus, a large potential difference occurs between the potential of the photosensitive body and the voltage applied to the magnetic brush at each end portion of the magnetic brush contact charging apparatus in the longitudinal direction. Charging magnetic particles then move onto the photosensitive body to compensate for this potential difference while holding charge, resulting in carrier adhesion.

SUMMARY OF THE INVENTION

It is an object of the present invention to provide an image forming apparatus which prevents adhesion of magnetic particles from a charging apparatus to an image bearing body.

It is another object of the present invention to provide an image forming apparatus which prevents an image previously formed on an image bearing body from remaining as a memory when an image is formed on the image bearing body.

It is still another object of the present invention to provide an image forming apparatus which erases an optical memory in forming an image on a photosensitive body.

It is still another object of the present invention to provide an image forming apparatus which prevents the occurrence of an optical memory and adhesion of magnetic particles to a photosensitive body when an amorphous silicon photosensitive body and a magnetic brush charging apparatus are used in combination.

The other objects and features of the present invention will be apparent from the following detailed description in conjunction with the accompanying drawings.

DETAILED DESCRIPTION OF THE PREFERRED EMBODIMENTS (First Embodiment)

Figure 1:
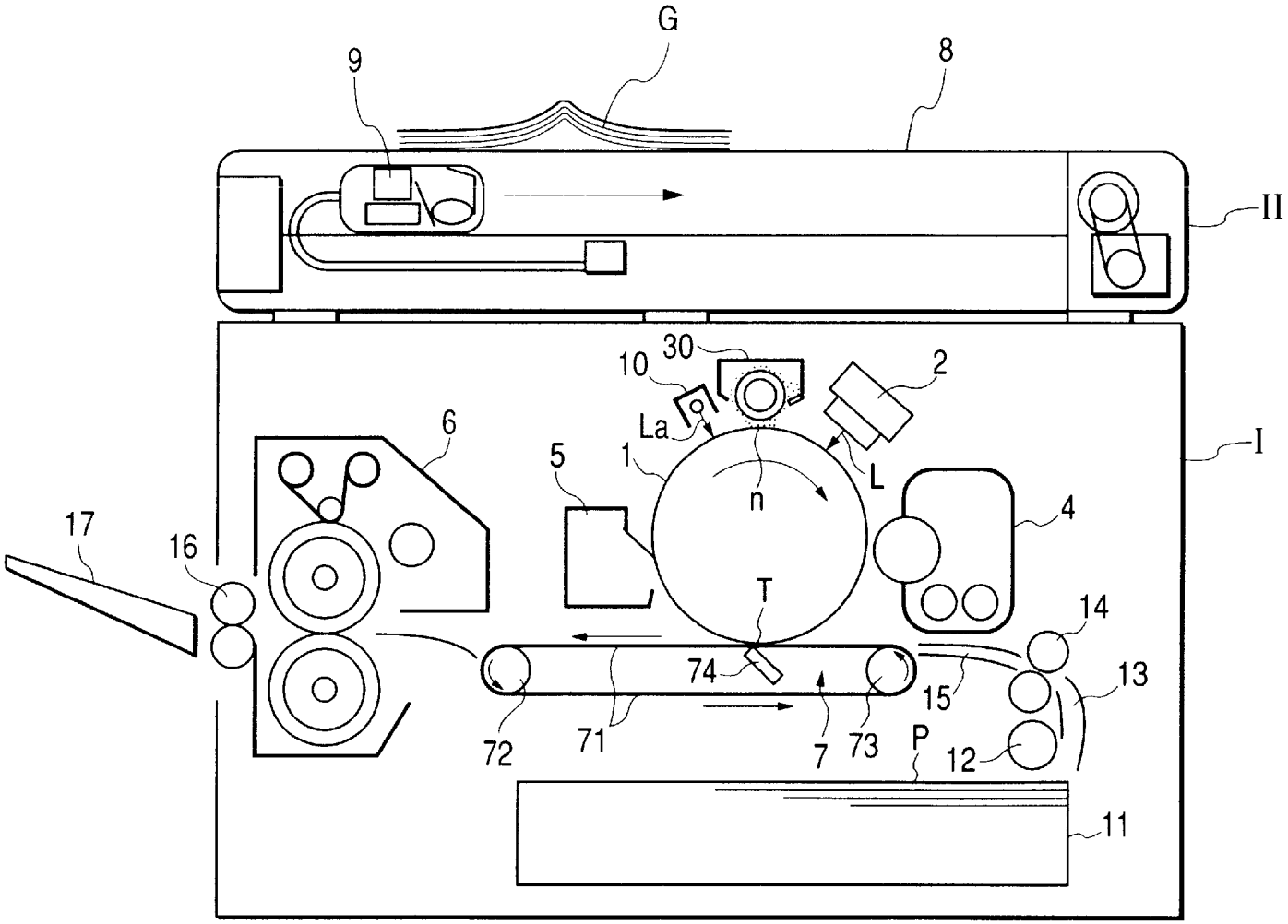
FIG. 1 is a view showing the schematic arrangement of an image forming apparatus according to the first embodiment.

FIG. 1 is a schematic view showing the arrangement of an image forming apparatus according to the present invention. The image forming apparatus according to the first embodiment is a laser beam printer using a transfer electrophotographic process.

An image reader (image scanner) II is mounted on a laser beam printer I.

In the image reader II, an original glass 8 is fixed on the upper surface of the apparatus. An original G is placed on the upper surface of the original glass 8 with a surface to be copied facing down, and an original press plate (not shown) is set on the original G.

An image read unit 9 is comprised of an original illumination lamp, short-focus lens array, CCD sensor, and the like. This unit 9 is reciprocated from the home position indicated by the solid lines, which is located on the left side of the glass below the original glass 8, to the right side along the lower surface of the glass on the basis of an operation signal. When the image read unit 9 reaches a predetermined end point in the forward direction, it is reversed in the backward direction to return to the home position indicated by the solid lines.

In the process of reciprocating the image read unit 9, the image surface of the original G on the original glass 8, which faces down, is sequentially illuminated/scanned by the original illumination lamp of the image read unit 9 from the left side to the right side. The reflected light of the illumination/scanning light from the original surface is formed into an image on the CCD sensor through the short-focus lens array.

The CCD sensor is comprised of a light-receiving portion, transferring portion, and output portion. The CCD light-receiving portion converts a light signal into a charge signal. The transferring portion sequentially transfers the signal to the output portion in synchronism with clock pulses. The output portion converts the charge signal into a voltage signal. The output portion amplifies the signal, decreases its impedance, and outputs the resultant signal. The analog signal obtained in this manner is subjected to known image processing and converted into a digital signal. This signal is then sent to the printer I.

The image information on the original G is photoelectrically read as a time-series electrical digital pixel signal (image signal) by the image reader II.

The printer I includes an electrophotographic photosensitive body 1 in the form of a rotating drum which serves as an image bearing body. The photosensitive body 1 in this embodiment is an A-Si-based photosensitive body, which is rotated about the central shaft at a predetermined peripheral velocity in the clockwise direction indicated by the arrow.

An ante-charge exposing apparatus 10 serves as a discharging means for discharging the photosensitive body. A magnetic brush contact charging apparatus 30 is placed downstream from the ante-charge exposing apparatus 10 in the rotating direction of the photosensitive body. In the process of rotation, the photosensitive body 1 undergoes ante-charge exposure (uniform exposure throughout the entire surface) La by the ante-charge exposing apparatus 10 to erase an optical memory, and is then uniformly charged to a predetermined polarity (e.g., positive)/potential by the magnetic brush contact charging apparatus 30.

An image exposing apparatus 2 then performs image exposure on the uniformly charged surface of the rotating photosensitive body 1. In this embodiment, the image exposing apparatus 2 is a laser exposure means (laser scanner). Scanning exposure is performed by using a laser beam L output from this laser exposure means, which is modulated in accordance with an image signal sent from the image reader II to the printer I. With this operation, electrostatic latent images corresponding to the image information on the original G photoelectrically read by the image reader II are sequentially formed on the rotating photosensitive body 1.

The electrostatic latent images are sequentially developed into toner images by a developing apparatus 4. For example, the developing apparatus 4 is a contact developing scheme or reversal developing type apparatus containing a so-called two-component developer having toner particles and carrier particles. That is, the charge polarity of the toner is the same as that of the charging apparatus 30.

One transferring material P as a recording medium (image receiving member) stored in a paper feed cassette 11 is fed to a transferring apparatus 7 of a transfer belt type by a paper feed roller 12 through a sheet path 13, registration roller pair 14, and sheet path 15 at a predetermined control timing, and is fed to a transferring portion T. An endless transfer belt 71 is looped around a driving roller 72 and driven roller 73 and is pivoted in the rotating direction of the photosensitive body 1, i.e., clockwise direction, at almost the same peripheral velocity as the rotating peripheral velocity of the photosensitive body 1. A transfer charging blade 74 is placed inside the transfer belt 71 to press the upper belt portion of the transfer belt 71 against the photosensitive body 1 to form a transfer nip portion T. In addition, when a transfer bias is applied from a transfer bias application power supply (not shown) to the transfer charging blade 74, the transferring material P is charged from its lower surface with a polarity opposite to that of the toner. With this operation, the toner images on the rotating drum 1 are sequentially and electrostatically transferred onto the surface of the transferring material P that passes through the transferring portion T. In this case, the charge polarity of a transfer voltage applied to the transfer charging blade 74 is opposite to the charge polarity of the charging apparatus 30.

The transferring material P having undergone transfer of the toner images through the transferring portion T is sequentially separated from the surface of the photosensitive body 1 and conveyed to a fixing apparatus 6, in which the toner images are thermally fixed. The resultant transferring material P is output as a copy or printout from a paper discharge roller 16 to a paper discharge tray portion 17.

Contaminants such as residual toner after transfer are removed from the surface of rotating photosensitive body 1 by a cleaner 5 after the separation of the transferring material to allow the photosensitive body 1 to be repeatedly used for image formation.

Figure 2:
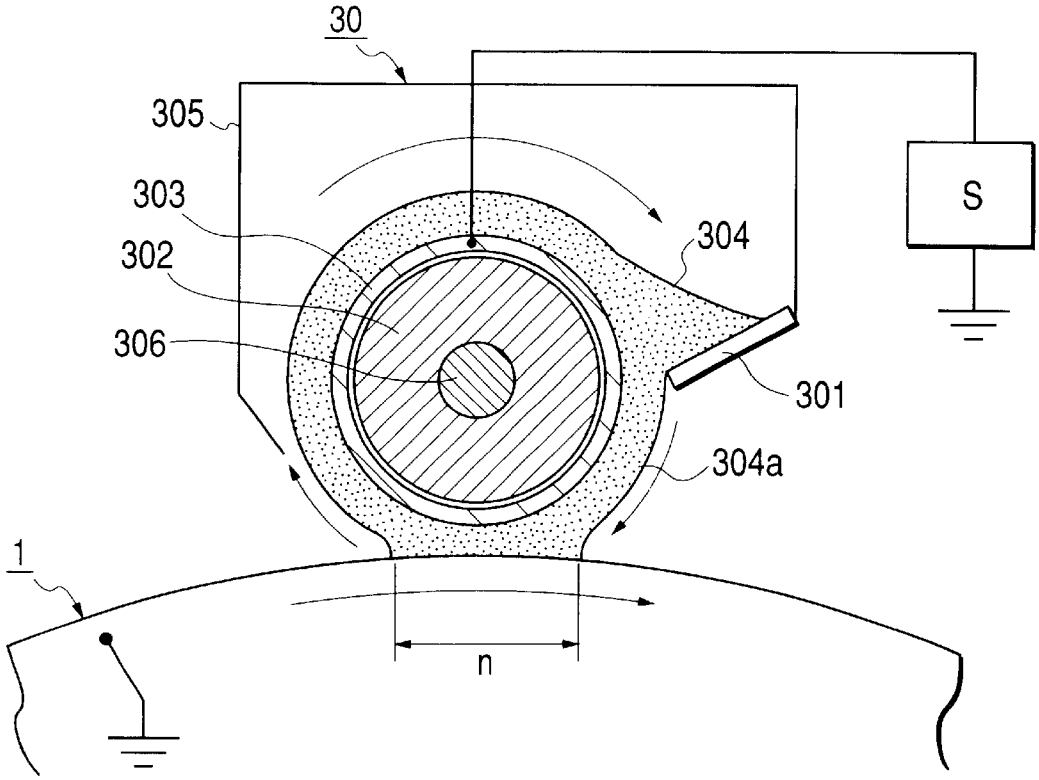
FIG. 2 is an enlarged cross-sectional view of a magnetic brush contact charging apparatus.
Figure 3:
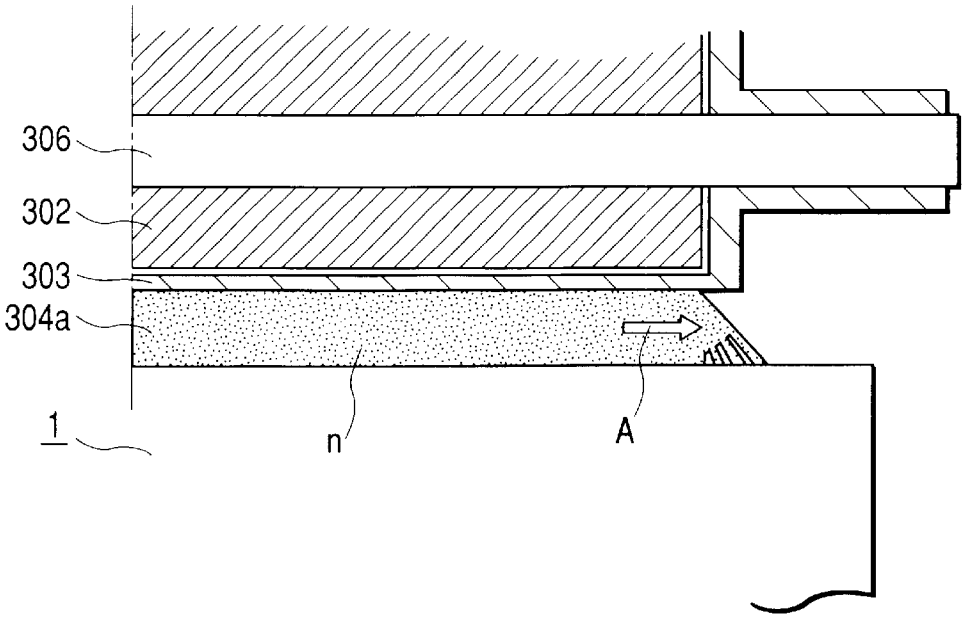
FIG. 3 is a view for explaining carrier adhesion at an end portion of a magnetic brush.

Since the magnetic brush contact charging apparatus 30 is identical to the sleeve rotation type apparatus described above with reference to FIGS. 2 and 3, a description thereof will be omitted.

Figure 4:
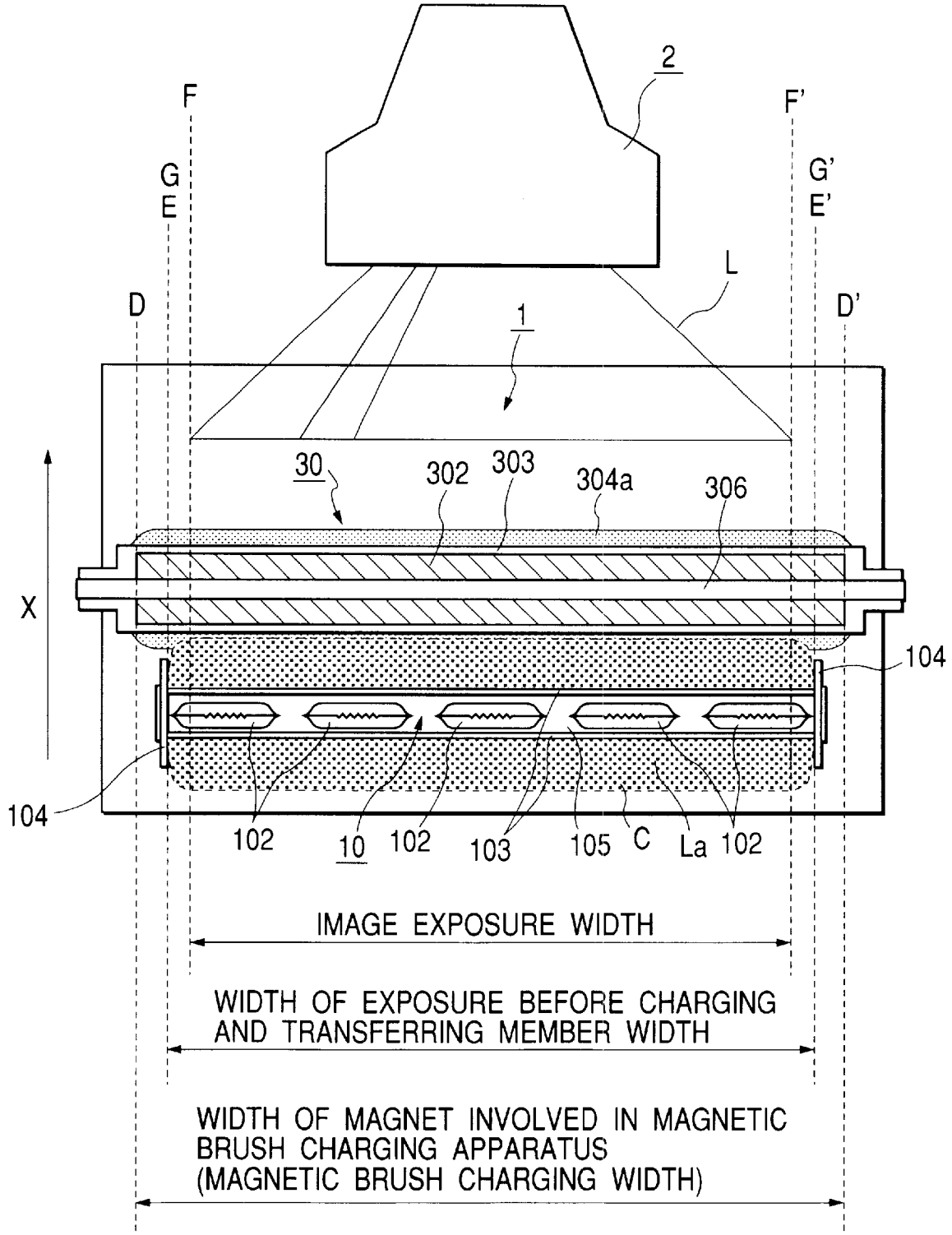
FIG. 4 is a schematic view showing the arrangements of a magnetic brush contact charging apparatus and ante-charge exposing apparatus and the relationship between the image exposure width, the width of exposure before charging, and the magnetic brush charging width.

FIG. 4 is a developed plan view showing the a-Si photosensitive body 1 centered on the magnetic brush contact charging apparatus 30 when viewed from above so as to clearly show the positional relationship between the front and rear portions of the charging apparatus 30 on the photosensitive body 1.

FIG. 4 is a see-through view of the magnetic brush contact charging apparatus 30 to clearly show the longitudinal end portions of the magnetic brush. The width of the magnetic brush in contact with the photosensitive body 1 is the longitudinal width indicated by dotted lines D and D', which is almost equal to that of a magnet 302 housed in a nonmagnetic sleeve 303.

The ante-charge exposing apparatus 10 is placed upstream from the magnetic brush contact charging apparatus 30 in a photosensitive body moving direction X, and performs the ante-charge exposure La on the a-Si photosensitive body 1.

The image exposing apparatus 2 is placed downstream from the magnetic brush contact charging apparatus 30 in the photosensitive body moving direction X, and exposes the photosensitive body 1 with the laser beam L ON-OFF-modulated in accordance with a time-series electrical digital image signal of image information. The electrostatic latent image formation range at this time corresponds to the scan range of the laser beam L in the longitudinal direction, and has a width indicated by dotted lines F and F' in FIG. 4.

The formation of an optical memory can be prevented by uniformly performing exposure La on the photosensitive body 1 exposed by the image exposing apparatus 2 by using the ante-charge exposing apparatus 10 before charging.

Figure 5:
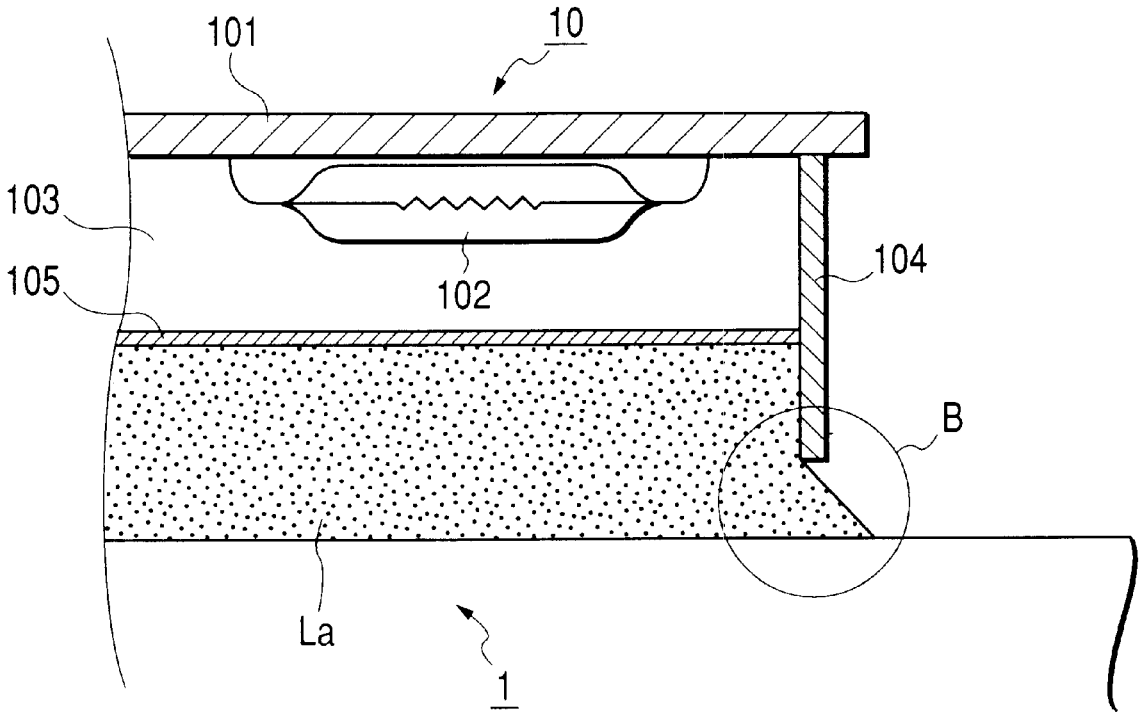
FIG. 5 is an enlarged longitudinal sectional view of one end portion of the ante-charge exposing apparatus.

The ante-charge exposing apparatus 10 will be described in detail with reference to FIGS. 4 and 5. FIG. 5 is a partial sectional view of a longitudinal end portion of the ante-charge exposing apparatus 10 taken along a direction perpendicular to the surface of the photosensitive body 1.

The ante-charge exposing apparatus 10 used in this embodiment emits light when power is supplied from a power supply (not shown) to a plurality of tube lamps 102 fixed on a base 101 in the longitudinal direction with interconnections, and performs the exposure La on the photosensitive body 1.

The light emitted from the tube lamps 102 is blocked by a side plate 103 extending in the longitudinal direction and an end side plate 104 at the longitudinal end portion to partially expose the surface of the photosensitive body 1 within an area C in FIG. 4.

A semi-transparent diffusion plate 105 is placed in front of the tube lamps 102 to reduce irregularity of the light emitted from the tube lamps 102 in the longitudinal direction.

In a conventional ante-charge exposing apparatus, not much consideration is given to the exposure range of a longitudinal end portion, and the exposure range becomes larger than the magnetic brush width (longitudinal charging width) D–D' of the magnetic brush contact charging apparatus 30. As a consequence, carrier adhesion occurs. That is, charging magnetic particles 304 from an end portion of a magnetic brush 304*a* adhere onto the photosensitive body 1.

In this embodiment, the longitudinal width (longitudinal exposure width, i.e., a discharging width for discharge of the photosensitive body) E–E' is smaller than the magnetic brush width D–D' of the magnetic brush contact charging apparatus 30, and the side plates 104 are arranged on two end portions of the ante-charge exposing apparatus 10. These end side plates 104 are extended toward the surface of the photosensitive body to suppress the divergence of exposure light at the end portions as indicated by a circle B in FIG. 5, thereby preventing an unnecessary potential difference on the photosensitive body 1 with respect to the magnetic brush end portions. This further prevents carrier adhesion.

In this case, a width E–E' of exposure before charging is preferably set to a width that can prevent carrier adhesion on the magnetic brush contact charging apparatus 30 without impairing the optical memory preventing effect. More specifically, this width needs to be fall within the range defined by $$\text{width } F\text{–}F' < \text{width } E\text{–}E' < \text{width } D\text{–}D'$$

As a factor that lowers the potential on the surface of the photosensitive body 1, a transferring member must be considered together. In this embodiment, a width G–G' of the transfer charging blade 74 as a transferring member is set in the same longitudinal width range as that of the longitudinal exposure width E–E' described above.

There is provided an image forming apparatus which can prevent both carrier adhesion from the end portions of the magnetic brush contact charging apparatus 30 and the formation of an optical memory in using the a-Si photosensitive body 1 by performing the ante-charge exposure La and image formation in this placement and arrangement.

(Second Embodiment)

Figure 6:
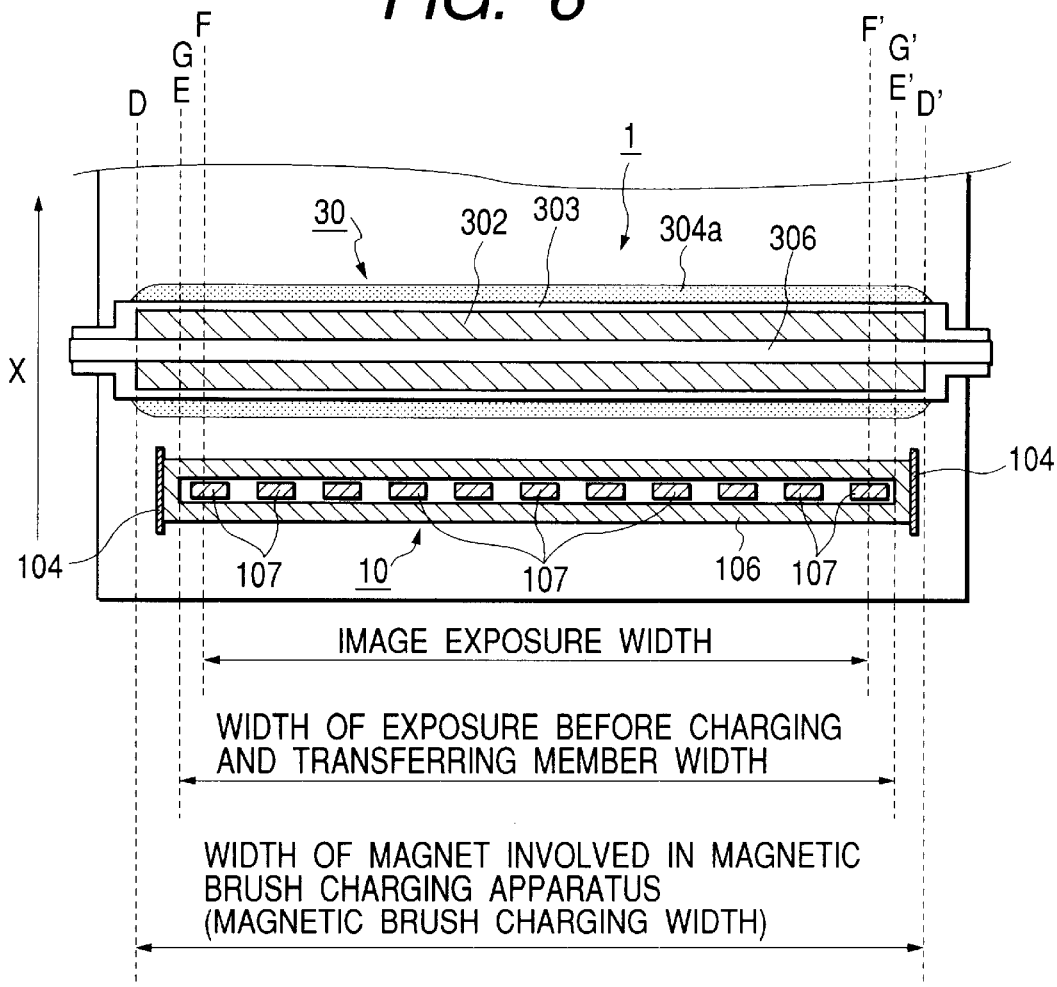
FIG. 6 is a schematic view showing the arrangements of a magnetic brush contact charging apparatus and ante-charge exposing apparatus and the relationship between the image exposure width, the width of exposure before charging, and the magnetic brush charging width in the second embodiment.
Figure 7:
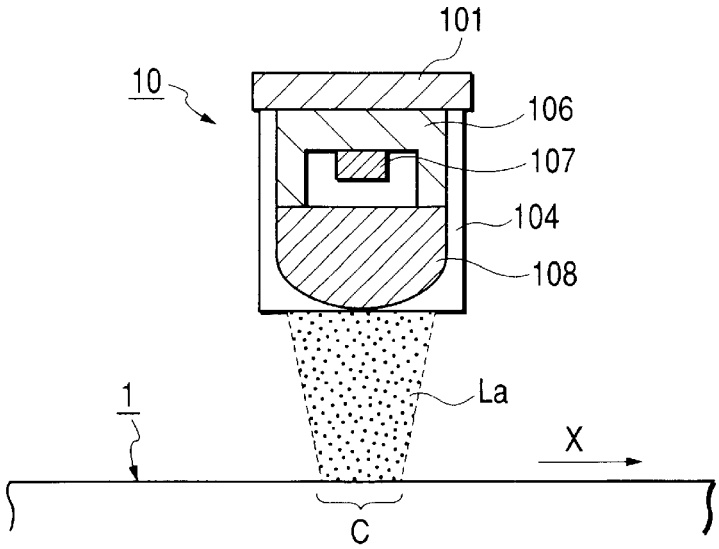
FIG. 7 is an enlarged cross-sectional view of the ante-charge exposing apparatus.

FIGS. 6 and 7 show another form of the ante-charge exposing apparatus 10 in the first embodiment. FIG. 6 is a view showing the from and arrangement of an ante-charge exposing apparatus 100 viewed from the same direction as that in FIG. 4. FIG. 7 is a cross-sectional view of the ante-charge exposing apparatus 100.

The ante-charge exposing apparatus 100 of this embodiment is comprised of an LED light-emitting element array and cylindrical lens. More specifically, an LED light-emitting element array 106. 107 is mounted on a landscape base 101, and a semi-cylindrical cylindrical lens 108 is attached to the light-emitting surface of the LED light-emitting element array. The LED light-emitting element array is formed by arranging a plurality of LED light-emitting elements 107 on the inner bottom surface of the landscape channel member 106 having a U-shaped cross-section along the longitudinal direction.

Voltages are applied from a power supply (not shown) to the LED light-emitting elements 107. The emitted light is then focused by the cylindrical lens 108 to perform uniform exposure La (exposure before charging) on the surface of a photosensitive body 1. Since a range C for this exposure does not spread in the rotating direction (circumferential direction) of the photosensitive body 1 due to the effect of the cylindrical lens 108, exposure light La does not strike a nip portion other than the end portions of a magnetic brush contact charging apparatus 30 as shown in FIG. 4. This can further suppress carrier adhesion.

End side plates 104 are arranged at the longitudinal end portions of the ante-charge exposing apparatus 100 to prevent leakage of the exposure light La, thereby preventing adhesion of carriers to the end portions of the magnetic brush.

The setting of a longitudinal width (width of exposure before charging) E–E' of the ante-charge exposing apparatus 100 is a characteristic feature of the present invention.

This width satisfies the relationship given by image exposure width F–F'<width of exposure E–E' before charging<magnetic brush charging width D–D'

As described above, the use of the ante-charge exposing apparatus 100 of this embodiment can prevent both the formation of an optical memory on the a-Si photosensitive body 1 and carrier adhesion from the end portions of the magnetic brush contact charging apparatus 30. This can also suppress carrier adhesion on the entire surface of the magnetic brush contact charging apparatus 30 in the longitudinal direction.

The present invention is not limited to the embodiments described above, and any modifications can be made within the spirit and scope of the invention.

What is claimed is:

1. An image forming apparatus comprising:

an amorphous silicon photosensitive body;

charging means for charging said photosensitive body, said charging means including a magnetic brush which is brought into contact with said photosensitive body and is formed by a magnetic particle layer; and pre-exposing means for exposing said photosensitive body after an image formed on said photosensitive body is transferred to an image receiving member before said photosensitive body is charged by said charging means, said pre-exposing means exposing said photosensitive body with an exposure width smaller than a width with which said charging means charges said photosensitive body in a longitudinal direction of said charging means, wherein the exposure width is larger than an image formation width in the longitudinal direction of said charging means.

2. An image forming apparatus according to claim 1, wherein the exposure width corresponds to an area which does not overlap a contact portion where the magnetic brush comes into contact with said photosensitive body.

3. An image forming apparatus according to claim 1, further comprising a transferring member for transferring an image formed on said photosensitive body onto the image receiving member, wherein a charging width of said transfer member is smaller than the width with which said charging means charges said photosensitive body in the longitudinal direction of said charging means.

4. An image forming apparatus according to claim 3, wherein a charge polarity of said charging means is opposite to a charge polarity of said transferring member.

5. An image forming apparatus according to claim 1, further comprising cleaning means for cleaning said photosensitive body, wherein said pre-exposing means is placed downstream from said cleaning means and upstream from said charging means in a moving direction of said photosensitive body.

6. An image forming apparatus according to claim 1, wherein said charging means performs injection charging of said photosensitive body.

7. An image forming apparatus comprising:

an amorphous silicon photosensitive body;

charging means for charging said photosensitive body, said charging means including a magnetic brush which is brought into contact with said photosensitive body and is formed by a magnetic particle layer;

pre-exposing means for exposing said photosensitive body after an image formed on said photosensitive body is transferred to an image receiving member before said photosensitive body is charged by said charging means, said pre-exposing means exposing said photosensitive body with an exposure width smaller than a width with which said charging means charges said photosensitive body in a longitudinal direction of said charging means; and electrostatic image forming exposing means for forming an electrostatic image by exposing said photosensitive body charged by said charging means, wherein the exposure width is larger than an exposure width with which said electrostatic image forming exposing means exposes said photosensitive body in the longitudinal direction of said charging means.

8. An image forming apparatus comprising:

an image bearing body;

charging means for charging said image bearing body, said charging means including a magnetic brush which is brought into contact with said image bearing body and formed by a magnetic particle layer; and discharging means for discharging said image bearing body after an image formed on said image bearing body is transferred to an image receiving member before said image bearing body is charged by said charging means, wherein said discharging means discharges said image bearing body with a discharging width smaller than a width with which said charging means charges said image bearing body in a longitudinal direction of said charging means, wherein the discharging width is larger than an image formation width in the longitudinal direction of said charging means.

9. An image forming apparatus according to claim 8, wherein the discharging width corresponds to an area which does not overlap a contact portion where the magnetic brush comes into contact with said image bearing body.

10. An image forming apparatus according to claim 8, further comprising a transferring member for transferring an image formed on said image bearing body onto the image receiving member, wherein a charging width of said transferring member is smaller than the width with which said charging means charges said image bearing body in the longitudinal direction of said charging means.

11. An image forming apparatus according to claim 10, wherein a charge polarity of said charging means is opposite to a charge polarity of said transferring member.

12. An image forming apparatus according to claim 8, further comprising cleaning means for cleaning said image bearing body, wherein said discharging means is placed downstream from said cleaning means and upstream from said charging means in a moving direction of said image bearing body.

13. An image forming apparatus according to claim 8, wherein said charging means performs injection charging of said image bearing body.

14. An image forming apparatus comprising:

an image bearing body;

charging means for charging said image bearing body, said charging means including a magnetic brush which is brought into contact with said image bearing body and formed by a magnetic particle layer;

discharging means for discharging said image bearing body after an image formed on said image bearing body is transferred to an image receiving member before said image bearing body is charged by said charging means, wherein said discharging means discharges said image bearing body with a discharging width smaller than a width with which said charging means charges said image bearing body in a longitudinal direction of said charging means; and electrostatic image forming exposing means for forming an electrostatic image by exposing said image bearing body charged by said charging means, wherein said image bearing body is a photosensitive body and the discharging width is larger than an exposure width with which said electrostatic image forming exposing means exposes said image bearing body.

* * * * *